US006477957B2

(12) United States Patent
Schmid et al.

(10) Patent No.: US 6,477,957 B2
(45) Date of Patent: Nov. 12, 2002

(54) IGNITION DEVICE FOR A SAFETY SYSTEM

(75) Inventors: Günther Schmid, Götzia (AT); Martin Schmid, Frastanz (AT)

(73) Assignee: Hirschmann Austria GmbH, Rankwell Brederis (AT)

( * ) Notice: Subject to any disclaimer, the term of this patent is extended or adjusted under 35 U.S.C. 154(b) by 0 days.

(21) Appl. No.: 09/870,927

(22) Filed: Jun. 1, 2001

(65) Prior Publication Data

US 2002/0030409 A1 Mar. 14, 2002

(30) Foreign Application Priority Data

Jun. 2, 2000 (DE) ..... 100 27 464

(51) Int. Cl.[7] ..... F42B 3/18
(52) U.S. Cl. ..... 102/202.2
(58) Field of Search ..... 102/202.2

(56) References Cited

U.S. PATENT DOCUMENTS 3,735,705 A * 5/1973 Hudson et al. ..... 102/202.2
4,335,654 A * 6/1982 Bratt ..... 102/202.12
4,378,738 A * 4/1983 Proctor et al. ..... 102/202.12
5,153,368 A * 10/1992 Fogle, Jr. ..... 102/202.2
5,200,574 A * 4/1993 Cunningham et al. ... 102/202.2
5,241,910 A * 9/1993 Cunningham et al. ... 102/202.2
5,279,225 A * 1/1994 Dow et al. ..... 102/202.2
5,345,872 A * 9/1994 Takahashi et al. ..... 102/202.14
5,355,800 A * 10/1994 Dow et al. ..... 102/202.2
5,634,660 A * 6/1997 Fink et al. ..... 102/202.14
5,691,498 A * 11/1997 Fogle, Jr. ..... 102/202.2
5,827,994 A * 10/1998 Gladden et al. ..... 102/275.1
5,932,832 A * 8/1999 Hansen et al. ..... 102/202.2
6,357,355 B1 * 3/2002 Fogle, Jr. ..... 102/202.2

FOREIGN PATENT DOCUMENTS

AT 000 522 U1 11/1995
DE 69222802 11/1992
DE 20002435 5/2000

* cited by examiner

*Primary Examiner*—Charles T. Jordan
*Assistant Examiner*—Jordan Lofdahl
(74) *Attorney, Agent, or Firm*—Fulbright & Jaworski

(57) ABSTRACT

An ignition device for a safety system such as an air bag or seat belt tightener for a motor vehicle having an ignition element and associated EMC protection means. The EMC protection means may comprise an EMC suppression comprising a ferrite core, which is encapsulated resistant to pressure. Encapsulation in a pot-like housing or between two half shells, with or without an intermediate coating, aids pressure resistance. Terminal means, such as terminal contacts or lugs, extends through the encapsulation to operatively connect the ignition element and the system's controls.

20 Claims, 3 Drawing Sheets

IGNITION DEVICE FOR A SAFETY SYSTEM

BACKGROUND OF THE INVENTION

1. Field of the Invention

The present invention relates to an ignition device for a safety system more particularly, the present invention relates to an ignition device for an airbag or a belt tightener of a motor vehicle safety system.

2. Description of the Related Technology

AT 000 522 U1 discloses a drive device for restraint systems in motor vehicles. This drive device consists of a housing with a cylinder in which a piston is movably located. The piston is pressed out of the cylinder when the working chamber of the housing is pressurized by ignition of a propellant charge which fills the chamber with gas.

The propellant charge is located in a partial area of the housing and is separated from the working chamber by a so-called "bursting bottom." Within the propellant charge is an ignition charge, which when detonated, causes the propellant charge to explode.

More particularly, the propellant charge (in which the ignition charge is inserted) is accommodated in a partial area of the housing and is separated from this partial area of the housing by a spacer sleeve. The ignition charge is connected to a control device by very thin feed lines. The partial area of the housing in which the propellant charge is located is closed by a cap.

In the area of the very thin feed lines there are means in the form of an iron-core bar reactor which is designed to provide Electromagnetic Compatibility (EMC) protection. These means of EMC protection are necessary so that the propellant charge is not unintentionally ignited by external electrical influences. The iron-core bar reactor must be connected to the feed lines and the ignition charge, which necessitates an additional step in the production of the ignition device.

SUMMARY OF THE INVENTION

One object of the invention is to provide an ignition device which is equipped with EMC protection which optimally prevents misfiring of the ignition device and is simple to produce.

This and other objects may be achieved by an ignition device comprising an ignition element which may be ignited by terminal means, such as terminal leads. The ignition element is disposed in a housing with EMC protection means.

According to one aspect of the invention, that the means for EMC protection comprise a ferrite core. Preferrably, the ferrite core is located tightly adjacent to the ignition element. Accordingly, as will be appreciated by one of ordinary skill in the art, external electrical influences (for example, high frequency effects) which would otherwise lead to ignition of the ignition element can be effectively prevented. Configuring the EMC protection means as a ferrite core is therefore preferable since this ferrite core (or several) can be pushed over the terminal leads. For example, the ferrite core may be located concentrically on the terminals means, making it possible to place it in the area of the terminal leads or in the contact area of the terminal leads with contact lugs of the ignition element.

According to the invention, these ferrite cores may be made by any suitable process, for example, they may be conventionally produced in a compacting process or injection process and then finished by means of a suitable sintering process. These sinter materials are generally very sensitive to external mechanical effects such as pressure, impact, or the like. If as a result of these mechanical influences, cracks appear in the ferrite core or parts of the ferrite core break off, the original action changes immediately as a result of the changing permeability of the ferrite core, which would lead to reduced EMC protection.

According to one aspect of the invention, the ferrite core is encapsulated to be resistant to pressure, i.e., has encapsulation such that it is effectively protected against external mechanical influences such as pressure, impact or the like. In this way the attained EMC protection is always preserved and the values (such as permeability) of the ferrite core can be maintained. This encapsulation also has the advantage that the ferrite core is effectively protected before its installation in the ignition device, for example, during transport, storage or the like. After installation, it is a good idea to encapsulate a partial area of the ignition element (the area of the terminal leads or terminal lugs of the ignition element) including the ferrite core placed on the terminal leads to be resistant to pressure.

According to the invention, there are various possibilities for pressure-resistant encapsulation of the ferrite core.

For example, according to one aspect of the invention, the ferrite core is preferably encapsulated in a pot-like housing to be resistant to pressure. In a presently preferred embodiment, the pot-like housing (which corresponds internally to the outside dimensions of the ferrite core is put over the ferrite core) so that the core is encapsulated. Any intermediate space which may remain between the housing and the ferrite core can be filled with any suitable material by any suitable means.

Alternatively, according to another aspect of the invention, the ferrite core is encapsulated to be resistant to pressure by at least two shells, preferably half shells. These two half shells (or several shells) preferably surround the ferrite core so that it is protected against external effects. Here too any remaining intermediate space can be filled with any suitable material by any suitable means, particularly when at least two shells are cemented to one another or when clipped together.

When using the pot-like housing or at least two shells, it is preferable that the ferrite core be protected before installation on the terminal means against external influences, i.e., the ferrite core should be suitably encapsulated to resist pressure. and after encapsulation be installed onto the terminal leads. Alternatively, it is preferable for the ferrite core to first be pushed onto the terminal leads and then encapsulated.

In one alternative embodiment of the invention, the ferrite core is at least partially, preferable in its totality, surrounded with a protective layer in a low pressure process, wherein the protective layer results in encapsulation resistant to pressure. As will be appreciated by one of ordinary skill in the art, extrusion coating in the low pressure process may therefore be necessary since damage to the ferrite core is prevented with this low pressure process. As will also be appreciated, the pressure in the low pressure process should be matched according to the ferrite core (material, geometry). Surrounding the ferrite core with a protective layer, according to the invention, has the advantage that the entire ignition element/EMC protection component unit has a compact structure and is mechanically stabilized. In automatic assembly this has the additional advantage that, for example, damage may be avoided during transport or storage of the preassembled ignition element/ferrite core unit.

According to one aspect of the invention, the ferrite core encapsulated resistant to pressure in a high pressure process is extrusion coated with another protective layer. In a preferred embodiment, the other protective layer forms (at least partially) the housing of the ignition device. Encapsulation of the ferrite core to resist pressure yields the above-described advantages. In addition, there is also the major advantage that the ferrite (core as a result of its encapsulation to resist pressure) can be extrusion coated in the high pressure process, since absent encapsulation, the increased pressure would be enough to damage the ferrite core or even destroy it. The encapsulation does not necessarily have to have the external shape of the housing of the ignition device. For this purpose it is provided that the ferrite core encapsulated resistant to pressure with its ignition element may be surrounded again by a housing, also preferably produced in a high pressure process.

Overall, the invention therefore has the advantage that the ignition device is effectively protected against EMC effects (and thus misfirings are avoided), and the production of the device can be easily accomplished and preferably automated.

BRIEF DESCRIPTION OF THE DRAWINGS

One embodiment of the ignition device according to the invention and various possibilities of encapsulation of the ferrite core insensitive to pressure, to which however the invention is not limited, are described below and explained using the figures, wherein.

DETAILED DESCRIPTION OF THE PREFERRED EMBODIMENT

Figure 1:
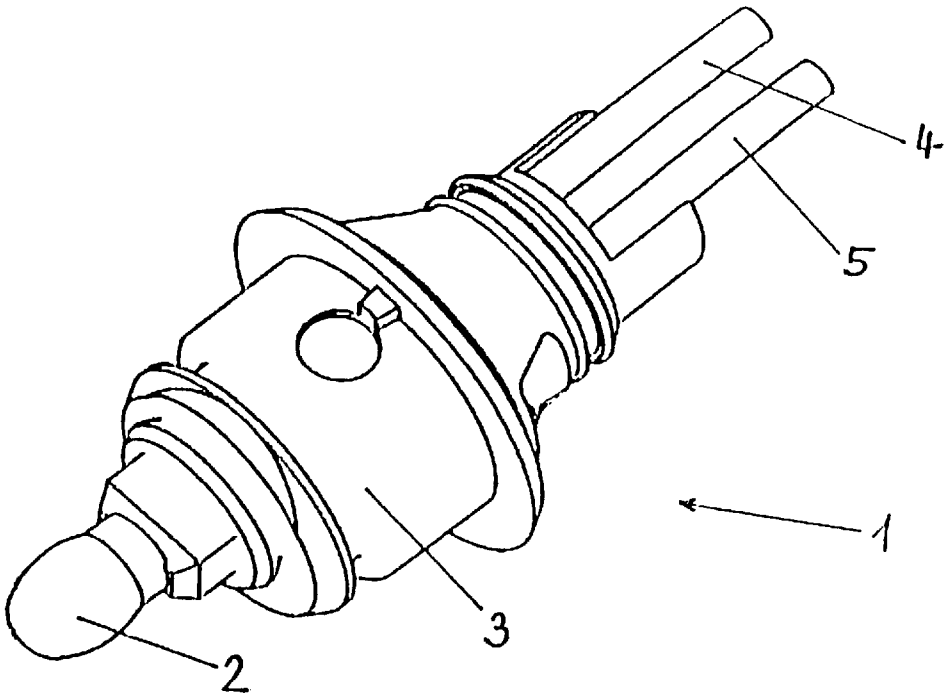
FIG. 1 shows a finished ignition device.

FIG. 1 shows an ignition device which can be produced as a preassembled unit. This ignition device 1 is installed as a unit at the corresponding site of the safety system of the airbag or the belt tightener or the like in the motor vehicle.

The ignition device 1 comprises an ignition element 2 which can be supplied with an electric pulse to cause the propellant charge (not shown) of the safety system to explode. The arrangement and the action of the propellant charge in this invention are not important so that in this respect a description is unnecessary.

The ignition element 2 sits on one end face of the ignition housing 3 with which the ignition device 1 can be installed in a housing of the safety system (not shown). Terminal leads 4 and 5 via which the ignition element 2 receives its electric pulse on the opposite end face of the ignition housing 3 are routed out of the latter, but can also be routed anywhere else out of this ignition housing 3 and can also be made as contact lugs, contact pins or the like. In the ignition housing 3 there are means for EMC protection (not shown in FIG. 1), their being made as a ferrite core and being located tightly adjacent to the ignition element 2.

Figure 2:
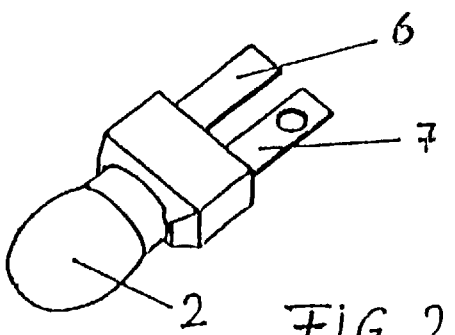
FIG. 2 shows an ignition element.

FIG. 2 shows a sample embodiment of the ignition element 2 which consists of a head with the ignition charge and contact lugs 6 and 7 for making electrical contact. The contact lugs 6 and 7 are connected to the terminal leads 4 and 5, or alternatively, the ignition element 2 has no contact lugs 6 and 7 at all, but instead the electrical terminal leads 4 and 5 are routed directly out of the ignition element 2.

Figure 3:
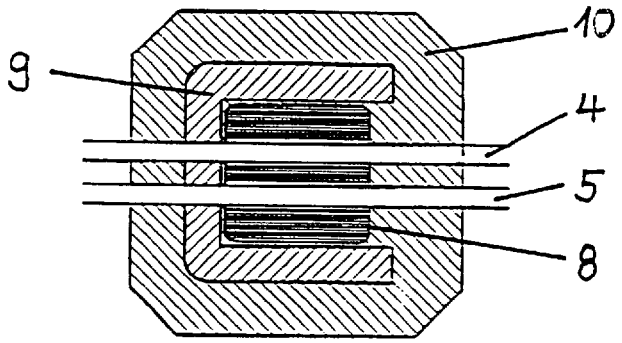
FIGS. 3 to 5 show different encapsulations of a ferrite core.
Figure 4:
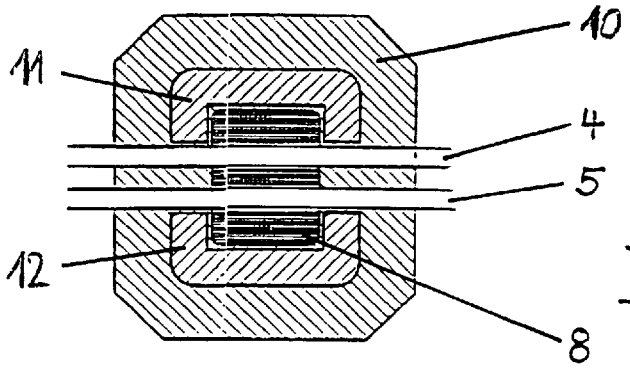
Figure 5:
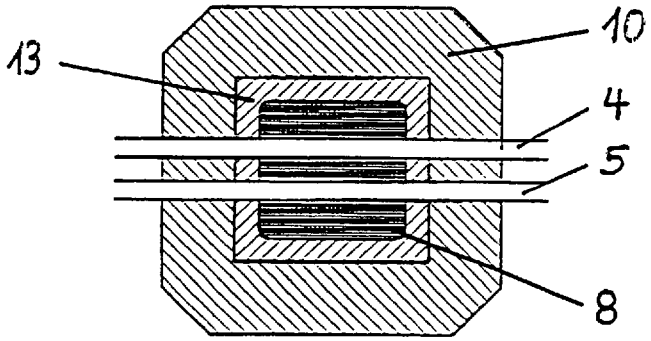

FIGS. 3 to 5 show different possibilities of encapsulation of a ferrite core 8 insensitive to pressure. The ferrite core 8 has penetrations (holes) through which the terminal leads 4 and 5 (or the contact lugs 6 and 7) are routed. One ferrite core may have two terminal leads, or alternatively, each terminal lead has its own ferrite core 8.

FIG. 3 shows the finished encapsulation of the ferrite core 8. The ferrite core 8 is preferably first pushed onto the terminal leads 4 and 5. Then, the pot-like housing 9 is put over the ferrite core 8. In doing so, the pot-like housing 9 likewise has penetrations for the terminal leads 4 and 5. After the ferrite core 8 is encapsulated resistant to pressure by pot-like housing, it is preferably surrounded by another protective layer 10, which is preferably an extrusion coating from a high pressure process. In a preferred embodiment, the other protective layer 10 is at least partially a component of the housing 3 or alternatively, the protective layer 10 forms the entire housing 3. With respect to the pot-like housing 9 it should be mentioned that the open side of the housing 9 can be closed with a cover through which the terminal leads 4 and 5 can be routed.

FIG. 4 shows that the encapsulation of the ferrite core 8 resistant to pressure may be done using two half shells 11 and 12. These half shells 11 and 12 are configured to allow the terminal leads 4 and 5 to be routed therethrough.

FIG. 5 shows that the ferrite core 8 may be surrounded by a protective layer 13. This protective layer 13 is preferably produced in a low pressure process. It is preferable for the ferrite core 8 to be surrounded with the protective layer 13 first. Then the terminal leads 4 and 5 may be inserted through the ferrite core 8. Alternatively, it is preferable for the ferrite core 8 (or one ferrite core at a time) to be pushed over the terminal leads 4 and 5 and then provided with the protective layer 13, which is preferably produced in a low pressure process. This alternative results in the ferrite core 8 being fixed at its position.

The ferrite core shown in FIGS. 3 to 5 is located in the vicinity of the head of the ignition element 2, and the encapsulation resistant to pressure can at the same time also comprise parts of the ignition element 2.

Figure 6:
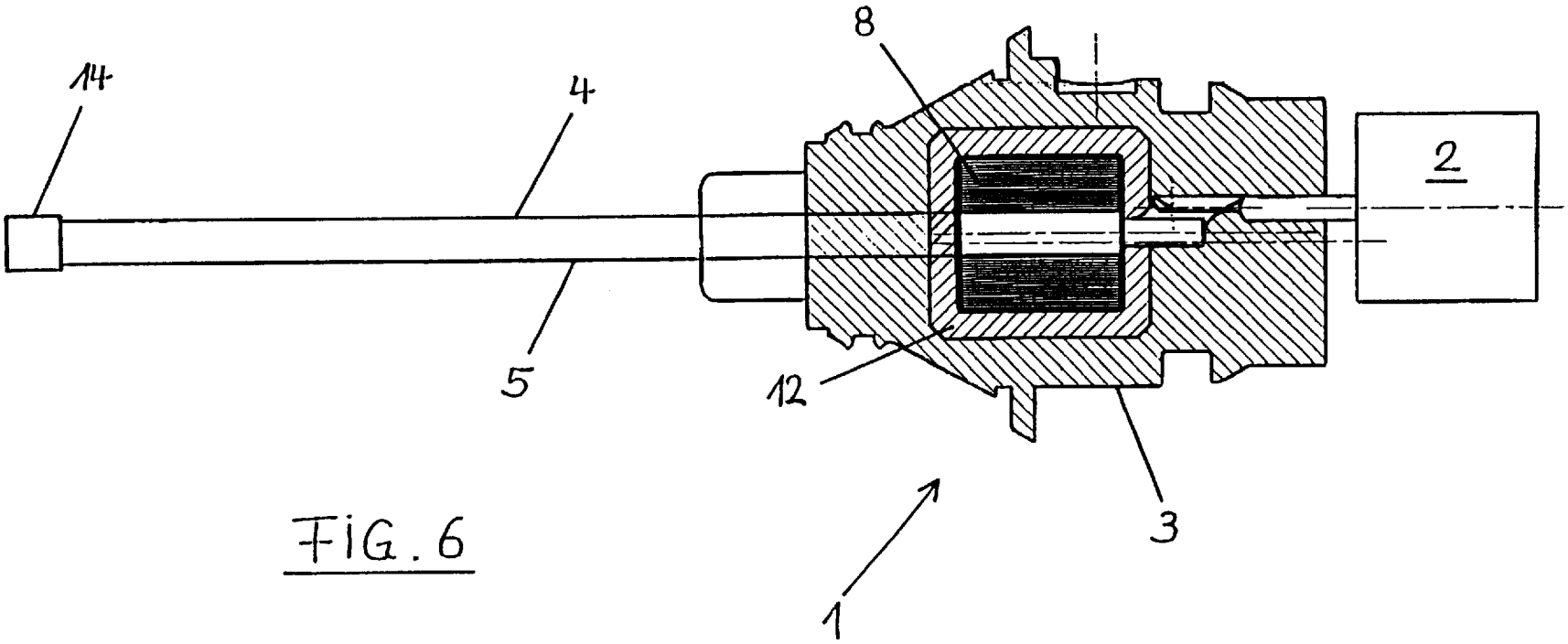
FIG. 6 shows another embodiment of a finished ignition device.

FIG. 6 shows another embodiment of an ignition device. The same elements have the same reference numbers as in the preceding figures. Reference number 14 labels a plug or the like via which the ignition device is connected to a control device (not shown).

What is claimed is:

1. An electric explosive ignition device comprising:

an explosive ignition element;

an EMC suppression means for attenuating transmission of EMC generated electric power to said ignition element, with said EMC suppression means being disposed adjacent said ignition element;

a pair of terminal leads extending from said ignition element, said pair of terminal leads being capable of transmitting electric power to ignite said ignition element, and said EMC suppression means being disposed adjacent said pair of terminal leads; and said EMC suppression means being surrounded and supported in a pressure resistant means for suppressing transfer of mechanical impact forces to said EMC suppression means.

2. The ignition device of claim 1, wherein said EMC suppression means comprises a ferrite core.

3. The ignition device of claim 2, wherein said pressure resistant means comprises a pot-like housing with said ferrite core being disposed in said pot-like housing.

4. The ignition device of claim 2, wherein said pressure resistant means comprises two half shells with said ferrite core housed between said half shells.

5. The ignition device of claim 2 , wherein said pressure resistant means comprises a protective layer disposed to partially encase said ferrite core.

6. The ignition device of claim 5, wherein said protective layer comprises a low pressure-process applied protective layer.

7. The ignition device of claim 2, wherein said pressure resistant means comprises an extrusion coating disposed to partially encase said ferrite core.

8. The ignition device of claim 7, wherein said extrusion coating comprises a high pressure-process applied protective layer.

9. The ignition device of claim 7, wherein said extrusion coating forms at least part of a housing surrounding said ferrite core.

10. The ignition device of claim 1, wherein said ignition device is disposed to be able to energize a safety system comprising an airbag system or seat belt tightener of a motor vehicle.

11. An electric explosive ignition device comprising: an explosive ignition element;

an EMC protection means for attenuating transmission of EMC generated electric power to said ignition element, said EMC protection means being surrounded and supported in a pressure resistant means for suppressing transfer of mechanical impact forces to said EMC protection means; and electric ignition means for actuating said ignition element with said EMC suppression means being disposed adjacent a pair of terminal leads used to transmit electric power to said ignition means.

12. The ignition device of claim 11, wherein said pressure resistant means comprises encapsulating said EMC protection means to suppress transfer of mechanical impact forces to said EMC protection means.

13. The ignition device of claim 12, wherein said pressure resistant means comprises a pot-like housing with said EMC protection means being encapsulated in said pot-like housing.

14. The ignition device of claim 12, wherein said pressure resistant means comprises two half shells with said EMC protection means being encapsulated in said two half shells.

15. The ignition device of claim 12, wherein said EMC protection means is encapsulated by a low pressure-process applied protective layer.

16. The ignition device of claim 15, further comprising housing means for encapsulating said EMC protection means.

17. The ignition device of claim 12, wherein said EMC protection means is encapsulated within an extrusion coating.

18. The ignition device of claim 17, wherein said extrusion coating is a high-pressure process applied extrusion coating.

19. The ignition device of claim 18, wherein said pressure resistant means further comprises housing means for encapsulating said EMC protection means.

20. The ignition device of claim 19, wherein said housing means comprises a second extrusion coating.

* * * * *